US005424086A

United States Patent [19]

Walker

[11] Patent Number: 5,424,086

[45] Date of Patent: Jun. 13, 1995

[54] METHOD OF MANUFACTURING DISPOSABLE INSERTS FOR NURSING BOTTLES

[76] Inventor: Rohan C. W. Walker, 268 Richardson Street, Middle Park, Victoria, Australia, 3206

[21] Appl. No.: 175,177

[22] Filed: Dec. 29, 1993

Related U.S. Application Data

[63] Continuation of Ser. No. 911,341, Jul. 8, 1992, abandoned, which is a continuation of Ser. No. 182,198, filed as PCT/AU87/00198, Jul, 3, 1987, abandoned.

[51] Int. Cl.[6] ..... B65D 85/80; B65B 31/02; A61J 9/00

[52] U.S. Cl. ..... 426/394; 426/399; 426/411; 426/413; 426/117; 53/434; 53/449; 215/11.3; 206/524.8

[58] Field of Search ..... 426/117, 399, 411, 115, 426/394, 410, 412, 413; 215/11.1-11.6; 220/403, 404; 206/524.8; 53/434, 449

[56] References Cited

U.S. PATENT DOCUMENTS

| | | | |
|---|---|---|---|
| 2,628,906 | 2/1953 | Horan | 426/117 |
| 2,881.935 | 4/1959 | Garred | 215/11.3 |
| 3,204,855 | 9/1965 | Boynton et al. | 215/11.3 |
| 3,255,923 | 6/1966 | Soto | 426/117 |
| 3,314,804 | 4/1967 | Kosikowski | 53/434 |
| 3,386,604 | 6/1968 | Fields | 215/11.3 |
| 3,395,822 | 8/1968 | Donleavy | 215/11.3 |
| 3,507,666 | 4/1970 | Cheney et al. | 215/11.1 |
| 3,523,026 | 8/1970 | Emerson et al. | 426/117 |
| 3,762,542 | 10/1973 | Grimes . | |
| 3,871,542 | 3/1975 | Hammer | 215/11.3 |
| 4,711,359 | 12/1987 | White et al. | 426/117 |

FOREIGN PATENT DOCUMENTS

| | | | |
|---|---|---|---|
| W08504574 | 10/1985 | WIPO | 426/117 |

*Primary Examiner*—Steven Weinstein

*Attorney, Agent, or Firm*—Andrus, Sceales, Starke & Sawall

[57] ABSTRACT

A system for feeding infants with an artificial formula includes the supply of a formula (20) into a bag (10) under sterile conditions. The bag (10) is not completely filled with formula (20), the formula (20) occupying one portion (12) with another portion (14) being collapsed as a result of withdrawal of air therefrom. The bag (10) is sealed. In use, the collapsed portion (14) of a bag (10) is inserted into a nursing bottle (16) and the formula (20) caused to flow into the collapsed portion (14) located within the bottle (16). The former filled portion (12) is removed to provide an opening to the formula (20) in the bag (10), and the free end is located between a cap (26) holding a teat (28) and the neck (18) of the bottle (16). The formula (20) may have an increased initial vitamin content to allow for loss of vitamins during storage.

2 Claims, 2 Drawing Sheets

METHOD OF MANUFACTURING DISPOSABLE INSERTS FOR NURSING BOTTLES

The present application is a continuation application of U.S. patent application, Ser. No. 07/911,341, filed Jul. 8, 1992, now abandoned, which, in turn, is a continuation application of U.S. patent application, Ser. No. 07/182,198, filed Mar. 2, 1988, and now abandoned.

This invention relates to the nursing of infants.

For the first six months of a baby's life, its sole source of nourishment is milk. This can be:

breast milk exclusively;

breast milk complimented with an artificial formula; or an artificial formula exclusively;

After six months, other foods may be introduced, but milk still forms a major part of a child's diet for at least a further year.

The incidence of breastfeeding of infants in the State of Victoria, Australia, showed a dramatic drop between 1950 to 1970 but since then has been climbing steadily due to:

the active encouragement of breastfeeding in hospitals;

literature supplied to mothers promoting breastfeeding; and the efforts of such organisations as the Nursing Mothers' Association of Australia.

Where an infant in the sub-six months of age group is not completely breastfed, it is generally considered to be essential that it be fed on an appropriate commercial infant formula. These formulas are scientifically designed to resemble human milk as closely as technology will permit, and stringent standards have been prescribed for their manufacture.

Such formulas are dispensed to infants in nursing bottles. Conventional nursing bottles have a glass or plastic body portion, and a closure in the form of a screwthreaded cap into which a teat is fitted.

All literature on infant feeding stresses the need for sterility in the ingredients and equipment used for making up an artificial feed, whether it be a proprietary formula or ordinary milk.

Two methods are normally used to sterilise bottles and teats. The equipment can either be immersed in a chemical sterilising solution for one hour, or may alternatively be placed in a suitable container, covered with water, brought to the boil and allowed to boil continuously in the water for ten minutes and then cooled. Great care must then be taken to ensure that all sterilised objects remain sterile Instructions supplied with all dried or concentrated infant formulas require the water which is to be added to reconstitute the formula to be boiled for at least ten minutes. The water will then take an hour or so to cool to body temperature. The powder or concentrate itself is kept in a sterile container which is usually fitted with a plastic lid which must itself be kept sterile. The contents are removed with a scoop which should also be sterilised and dried before use.

Since milk is a perfect medium for the growth of bacteria, prepared feeds are required to be kept under refrigeration.

Before being fed to the baby the feed needs to be heated to bring it to at least room temperature and, if preferred, to body temperature. This can take several minutes during which time the parent is usually listening to a crying baby.

Thus, conventional artificial formulas feeding arrangements have disadvantages compared to breastfeeding. Breast milk is sterile, it requires no preparation, it has no storage problems, it does not need to be warmed before feeding is able to commence, it contains all vitamins, minerals and nutritional value required, and it is readily available.

Despite the foregoing problems artificial feeding does have distinct advantages (a) Feeding duties can be shared the mother does not have to wake up for each night feed;

the mother does not have to take the baby with her to work, to a social function or elsewhere where breastfeeding may not be practical;

the child can be left with a baby sitter to give the mother more freedom.

(b) The mother knows precisely how much the baby takes in each feed.

(c) Some mothers choose not to breastfeed some women find it distasteful or messy;

some women are unable to breastfeed or have difficulty breastfeeding because of some physical problem.

Thus, a feeding system which can eliminate or minimise the problems of artificial feeding will obviously benefit a great many people. Some efforts have been made to provide improved feeding arrangements, but these have not been successful.

In addition, most babies suffer from colic. In the case of bottle-fed babies this is occasionally caused or contributed to by the baby sucking against the vacuum in the feeding bottle.

To cope with this problem manufacturers recommend that the plastic closure on a nursing bottle that holds the teat should be left slightly untightened so as to admit air into the bottle as the baby sucks. In practice, however this system does not always work well and milk often leaks from the cap of the bottle during feeding.

A number of manufacturers have produced bottles specifically designed to overcome this problem but they are expensive and inconvenient to use. For example, Australian patent application no. 77971/75 to Hammer proposes the use of flexible bags for containing nursing liquids, to be used within a particular outer structure, but such an arrangement is costly, in that all the elements of the arrangement must be purchased to replace existing bottles.

U.S. Pat. No. 3,762,542 to Grimes discloses the use of presterilised bags for insertion into a conventional 'nurser'. However, with such a system there is still scope for contamination of the formula dispensed into the bag.

It is an object of this invention to provide an improved system for feeding infants with artificial feeding formula.

The invention provides an infants' feeding system including a bag (10) containing a feeding formula (20) said bag (10) having been filled in sterile conditions, said filled bag (10) having only a first portion (12) thereof occupied by said formula (20), in a first orientation of said bag, and a second portion (14) there of which is collapsed due to the withdrawal of air therefrom in said first orientation. The second portion is capable of being inserted into a rigid container (16) such that the formula (20) may be caused to flow into said second portion (14)

located within said container (16) when said bag is inverted to a second orientation.

The invention also provides a method of producing a flexible container containing infants' formula (20), including the steps of providing an open-ended flexible container, partially filling said container with infants' formula (20), evacuating air from the remainder of said container to provide a collapsed portion thereof, and sealing said open end.

The invention further provides a sealed bag (10) containing infants' formula (20) and including a collapsed portion (14) for insertion into a container (16).

BRIEF DESCRIPTION OF THE DRAWINGS

An embodiment of the invention will be described in detail hereinafter, with reference to the accompanying drawings, in which.

In the embodiment of the invention an artificial infants' feeding formula is prepared in sterile conditions and is packed in a disposable bag 10 (FIG. 1) which preferably has the dimensions 180 mm (circumference) by 330 mm (length).

It is considered that as most plastics materials are highly permeable to oxygen they would be unsuitable for use in forming a bag 10 because over the anticipated shelf life of the formula contained therein, the vitamin content, particularly of vitamin C and folic acid, would drop dramatically.

In order to compensate for this loss by boosting the vitamin content before manufacture so as to arrive at an acceptable vitamin content at the end of the contemplated shelf life, the result would be an unacceptably high vitamin level at the start of the shelf life period. The solution is to use a plastic material with a minimum permeability. Special plastic laminates are manufactured for this purpose and are used with the Intasept (referred to hereinafter) and other systems. It is also possible for such a laminate to be produced in a tubular form by an extrusion or other process.

Figure 1:
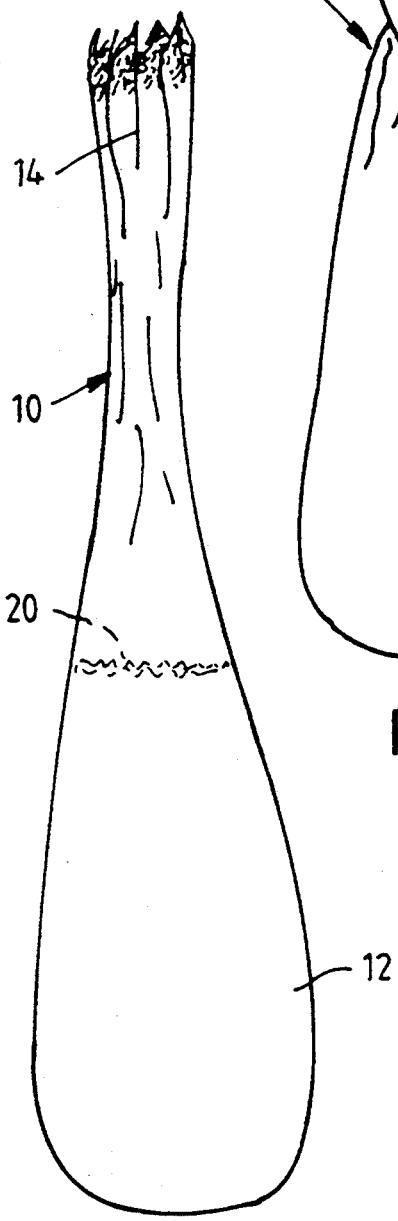
FIG. 1 is a perspective view of a bag filled with infant feeding formula.

Referring to FIG. 1, a single feed, that is, a predetermined volume of liquid formula, is packed into each bag 10 in sterile conditions using a UHT (ultra high temperature) process which is used to produce dairy products having long shelf life at ambient temperatures.

The manufacturing process involves

1. Mixing the formula;
2. Sterilising the mixed formula;
3. Packing the mixed formula into bags 10;
4. Packing the bags 10 into boxes Steps 1 and 4 will require a relatively simple plant. Step 2 will require the use of a UHT sterilising machine adjusted to the requirements of the product.

The greatest risk of contamination arises when the product leaves the UHT sterilising machine and enters the plastic bag 10. At this stage, assuming that the machine has been correctly adjusted and operated, the product should be sterile. The critical component is therefore the packing machine.

Because the product is intended for babies a high degree of reliability in the manufacturing process is essential. A one-in-five thousand failure rate, although possibly acceptable for UHT household milk, is not good enough. Either an aseptic packaging machine will be required for this particular application or alternatively, an existing machine with a high degree of reliability will need to be adapted.

The "Intasept" aseptic 2–30 liter filler manufactured by Wrightcel Limited is claimed to have a high degree of reliability and can be very easily adapted to this application with a minimum of cost.

The feed only occupies bottom section 12 of bag 10 when the bag is oriented as shown in FIG. 1, and the remainder 14 of the bag has the air evacuated therefrom. Immediately after filling, the bag is sealed by conventional means to prevent any contamination.

The size of the feed packaged in this way would depend upon the age of the baby. It is suggested that the feeds would be marketed in a 150 milliliter size and a 250 milliliter size. The size of the bag 10, however, would preferably remain the same.

The filled bags are then packed in cardboard boxes or the like, containing a given number of feeds to each box.

Being sterile, these boxes of infant feeds could be sold "off the supermarket shelf" and would not require refrigeration. The anticipated shelf life is three months.

FIGS. 2 to 5 inclusive demonstrate the manner in which a feed is prepared after a filled bag 10 has been purchased by a parent.

The parent would obtain a filled bag 10 from a cupboard or other storage area.

Figure 2:
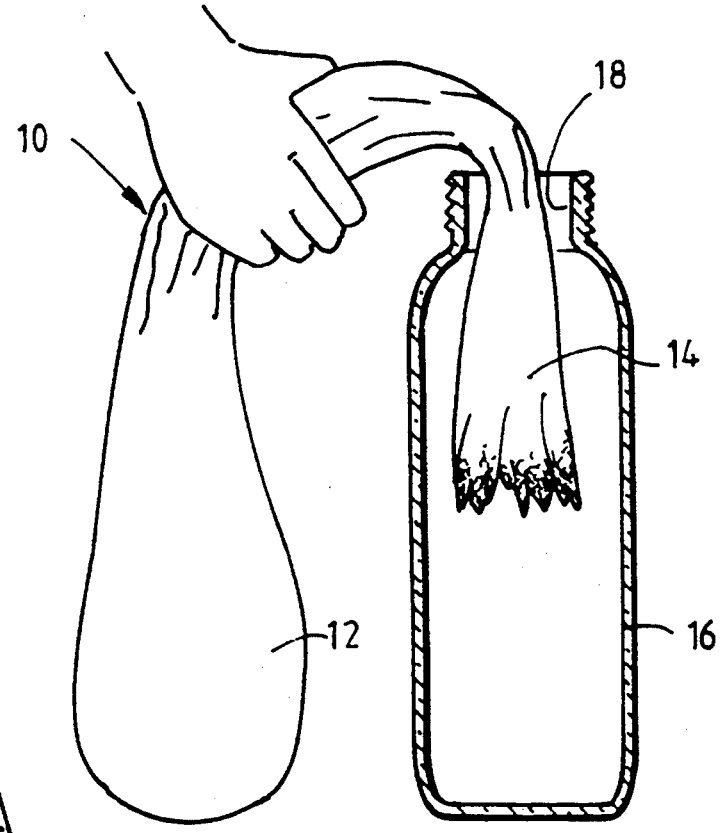
FIG. 2 is an elevation of a nursing bottle into which one end of the bag of FIG. 1 is being located.

As shown in FIG. 2, the parent would then insert the collapsed end 14 of bag 10 into the open end 18 of a conventional nursing bottle 16. The parent then raises filled end 12 of the bag 10 (FIG. 3) so that the orientation of the bag is inverted with respect to that of (FIG. 1) and so that the infants' formula 20 flows in the direction of the arrows to end 14, which is located in bottle 16. The formula 20 is then within the bottle 16, but is separated therefrom by the material from which bag 10 is formed.

Figure 3:
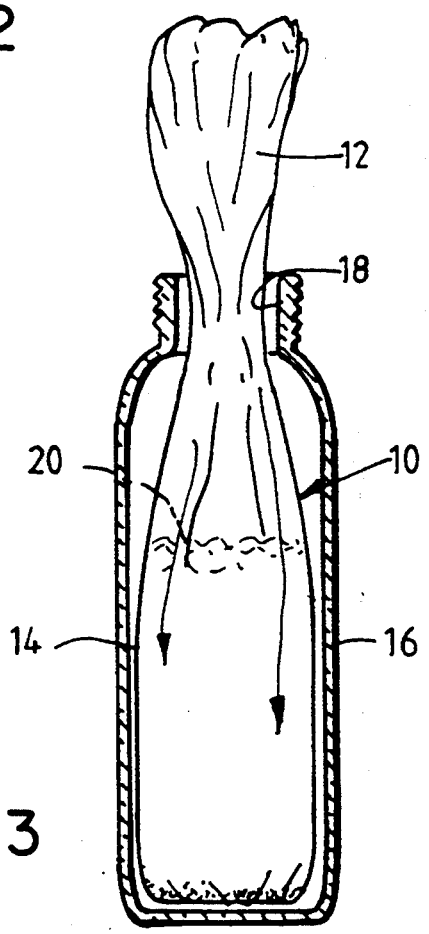
FIG. 3 is an elevation of the nursing bottle of FIG. 2 showing the liquid in the bag being transferred to the portion of the bag located in the bottle.
Figure 4:
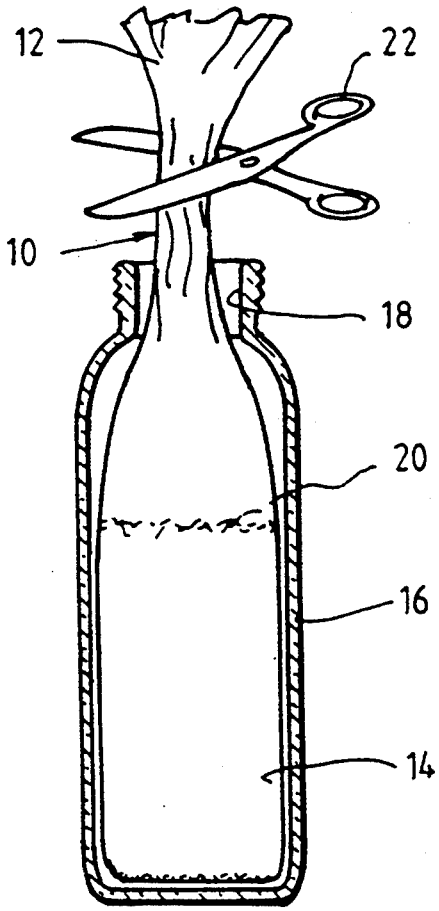
FIG. 4 is an elevation of the bottle and bag of FIG. 3, showing the bag about to be cut.
Figure 5:
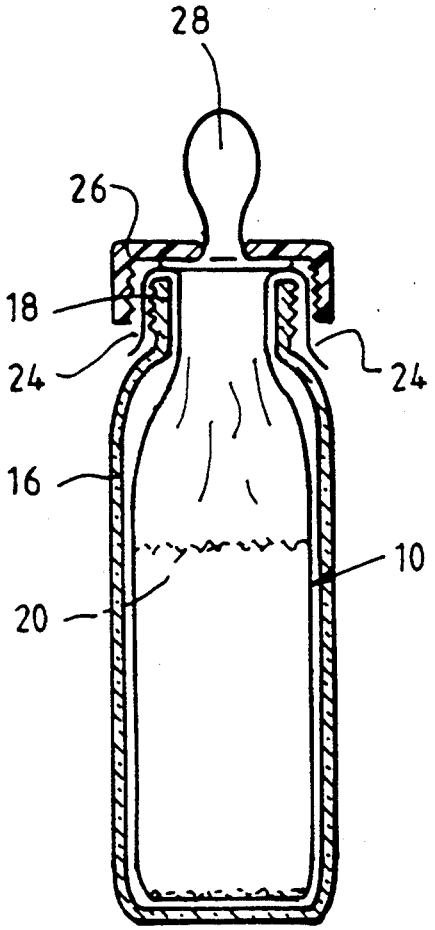
FIG. 5 is an elevation of a nursing bottle ready for use.

The former bottom portion 12 of the bag 10 which now protrudes above the neck 18 of the bottle 16 is now substantially deviod of milk, and the outer portion of this is cut off with scissors or the like 22 to form an open-ended bag leaving, preferably at least sixty millimiters of the bag 10 protruding above the neck of the bottle (FIG. 3).

The sides 24 of this open bag are now pulled down over the outside of the neck 18 of the bottle 16 (FIG. 4) and a cap 26 holding a test 28 is screwed onto the neck 18 of bottle 16, clamping the sides 24 between it and the neck 18. Thus, the bottle 16 is now ready for the formula to be dispensed to the infant.

It will be observed that the system of this invention has the following advantages:

(a) The bottle does not require sterilization, because no part of the milk touches it.

(b) The feed does not need to be heated since it is already at room temperature. If it is desired to bring the feed to blood temperature, only minimal heating is required.

(c) An unlimited number of feeds can be taken in the car, camping, on picnics or elsewhere where sterile facilities for the preparation of feeds are not available.

All that is required is a jar or other small container of sterilising solution for the teat and screw on cap.

(d) The mother can be certain that the feed is completely sterile because there is no possibility of contamination.

(e) The system fits all commonly used feeding bottles without any modification required.

(f) If a hole is made in the feeding bottle, the bag 10 will collapse like the inside of a wine cask as the baby feeds. Since the baby does not have to suck against a vacuum, the chances of colic are diminished.

It is considered that the formula packed in bags 10 will need to be initially boosted with vitamins, particularly vitamins A, C and folic acid, which will be lost:

due to the heat of the UHT process;

due to oxygen contamination during storage; or due to the effect of light.

Losses due to light can be minimised by packing the bags into an appropriate box. Oxygen contamination can be minimised by using an appropriate plastic laminate for the bags, as discussed hereinbefore.

The claims form part of the disclosure of this specification.

I claim:

1. A method of producing and using a sterile bag containing infant's formula and used with a nursing bottle having a top opening closable by a cover capable of dispensing the formula, said method comprising the steps of:

providing a bag of elongated and generally tubular shape and formed of a flexible material, said bag being longer than said bottle and having a first, closed, bottom end of an open, opposite, upper, second end;

aseptically partially filling said bag with said formula so that the formula only occupies a bottom portion of the bag above the closed bottom;

evacuating the air from the remainder of said partially filled bag and then aseptically sealing said open, upper end of said evacuated partially filled bag such that the upper portion of the bag above said partially filled portion is collapsed due to said evacuation of said air, said collapsed portion of said bag being capable of being inserted into said top opening of said bottle;

inserting said sealed upper end and said collapsed portion of said partially filled bag into said top opening of said bottle;

then raising said partially filled, bottom portion of said bag to invert said bag such that said formula flows into said collapsed portion toward said now inverted sealed end of said bag which is positioned in the bottle and until all of the formula has flows into the portion of the bag that is contained in the bottle, said first, closed end of said bag, now devoid of formula, protruding above said top opening of said bottle;

detaching said now empty first, closed end of said bag from the remainder of said bag;

pulling the portion of said bag that was adjacent the detached end over said top opening of said bottle; and securing said despensing cover to said top opening of said bottle to clamp said pulled over portion of said bag against said bottle.

2. The method according to claim 1 wherein the step of providing the bag is further defined as providing a bag formed of minimal permeability plastic laminate material.

* * * * *